US009944375B1

(12) United States Patent
Martin et al.

(10) Patent No.: US 9,944,375 B1
(45) Date of Patent: Apr. 17, 2018

(54) SYSTEMS AND METHODS FOR CONTROLLING TRIM POSITION OF A MARINE PROPULSION DEVICE ON A MARINE VESSEL

(71) Applicant: Brunswick Corporation, Lake Forest, IL (US)

(72) Inventors: Justin Martin, Saukville, WI (US); Daniel P. Klawitter, Beaver Dam, WI (US); Flint Grahl, Fond du Lac, WI (US); John A. Groeschel, Theresa, WI (US)

(73) Assignee: Brunswick Corporation, Mettawa, IL (US)

( * ) Notice: Subject to any disclaimer, the term of this patent is extended or adjusted under 35 U.S.C. 154(b) by 342 days.

(21) Appl. No.: 14/729,885

(22) Filed: Jun. 3, 2015

(51) Int. Cl.

| | |
|---|---|
| ***F15B 15/26*** | (2006.01) |
| ***B63H 20/10*** | (2006.01) |
| ***B63H 21/30*** | (2006.01) |
| ***F02B 61/04*** | (2006.01) |

(52) U.S. Cl.
CPC ..... *B63H 20/10* (2013.01); *B63H 21/302* (2013.01); *F02B 61/045* (2013.01); *F15B 15/26* (2013.01)

(58) Field of Classification Search
CPC ..... F15B 15/262; F15B 15/26; F15B 15/204
USPC ..... 91/437, 438
See application file for complete search history.

(56) References Cited

U.S. PATENT DOCUMENTS

| | | | | |
|---|---|---|---|---|
| 3,158,346 | A | 11/1964 | Jagger | |
| 3,785,328 | A | 1/1974 | Kloiber | |
| 4,050,359 | A * | 9/1977 | Mayer | B63H 20/10 91/422 |
| 4,637,800 | A | 1/1987 | Slattery | |
| 4,872,857 | A | 10/1989 | Newman et al. | |
| 5,527,194 | A | 6/1996 | Strong et al. | |
| 5,707,263 | A | 1/1998 | Eick et al. | |
| 6,176,170 | B1 | 1/2001 | Uppgard et al. | |
| 6,183,321 | B1 | 2/2001 | Alby et al. | |
| 6,273,771 | B1 | 8/2001 | Buckley et al. | |

(Continued)

OTHER PUBLICATIONS

Tuchscherer et al., Systems and Methods for Controlling Trim Position of a Marine Propulsion Device on a Marine Vessel, Unpublished U.S. Appl. No. 14/594,228, filed Jan. 12, 2015.

*Primary Examiner* — F. Daniel Lopez
*Assistant Examiner* — Daniel Collins
(74) *Attorney, Agent, or Firm* — Andrus Intellectual Property Law, LLP

(57) ABSTRACT

A system for controlling trim position of a marine propulsion device on a marine vessel includes a trim actuator having a first end configured to couple to the marine propulsion device and a second end configured to couple to the marine vessel. A controller controls position of the trim actuator between an extended position wherein the propulsion device is trimmed up with respect to the vessel and a retracted position wherein the propulsion device is trimmed down with respect to the vessel. A shock relief mechanism overrides position control by the controller and allows extension of the trim actuator upon the occurrence of an overpressure event. An arresting mechanism, when activated, prevents extension of the trim actuator beyond a certain limit. The controller selectively activates the arresting mechanism in response to a determination that the propulsion device is being commanded in reverse. Methods for controlling trim position are also included.

21 Claims, 10 Drawing Sheets

(56) References Cited

U.S. PATENT DOCUMENTS

| | | | | |
|---|---|---|---|---|
| 6,322,404 | B1 | 11/2001 | Magee et al. | |
| 6,419,534 | B1 | 7/2002 | Helsel et al. | |
| 6,832,939 | B2 * | 12/2004 | Rose | B63H 20/02 440/61 F |
| 7,156,709 | B1 | 1/2007 | Staerzl et al. | |
| 7,244,152 | B1 | 7/2007 | Uppgard | |
| 7,942,711 | B1 | 5/2011 | Swan | |
| 8,113,892 | B1 | 2/2012 | Gable et al. | |

* cited by examiner

SYSTEMS AND METHODS FOR CONTROLLING TRIM POSITION OF A MARINE PROPULSION DEVICE ON A MARINE VESSEL

FIELD

The present disclosure relates to propulsion systems for marine vessels and more particularly to systems and methods for controlling trim position of a marine propulsion device on a marine vessel.

BACKGROUND

The following U.S. patents and U.S. patent applications are incorporated by reference in their entirety:

U.S. Pat. No. 4,050,359 discloses a hydraulic system for a combined power trim and shock absorbing piston-cylinder unit of an outboard motor. The system includes a reversible pump means having a trim-up port connected by a pressure responsive pilot valve piston cylinder unit and a trim-down port through a reverse lock solenoid valve and a down-pilot spool valve providing full drain flow for trim-up and power flow for trim-down. An "up-reverse" pilot valve with a pressure operator is in parallel with the reverse lock valve and provides a restricted by-pass for limited trim-up in reverse. The trim-up hydraulic input or powered side of the cylinder units define a trapped hydraulic system creating "memory" in the system so after impact the motor returns to the original trim position. The return side permits relatively free-flow to permit "trail-out" under low impact. At high speed impact, the flow is restricted and cylinder pressure increases. At a selected point, a shock valve within the piston-cylinder opens and absorbs the shock forces. The piston unit includes an inner floating head telescoped into a head secured to the piston rod with a chamber thereby formed to store the liquid flow during shock movement. A metered orifice and check valve allows return to the original trim-set position.

U.S. Pat. No. 4,872,857 discloses a system for optimizing the operation of a marine drive of the type whose position may be varied with respect to the boat by the operation of separate lift and trim/tilt means. The system includes an automatic control system which stores preselected drive unit positions for various operating modes and is operative to return the drive unit to any pre-established position by pressing a selected operating mode positioning button. The various operating modes may include cruising, acceleration, trolling and trailering position, any of which may be selectively modified to accommodate changes in both operating or environmental conditions. This system may incorporate other optimization routines and/or automatic engine protection systems to provide virtually complete push button operation for complex marine drive unit positioning mechanisms.

U.S. Pat. No. 5,707,263 discloses a system for a trimmable marine stem drive that shifts the trimmable range on a conventional hydraulic trim system. The system includes an enlarged cylinder anchor pin hole in the drive shaft housing, an anchor pin smaller in size than the enlarged anchor pin hole located in the drive shaft housing, and a movable trim adjustment insert that is inserted into the enlarged anchor pin hole to secure the anchor pin in a fixed position within the enlarged hole. It is preferred that the enlarged anchor pin hole be a substantially horizontal elongated hole, and that the trim adjustment insert be placed rearward of the anchor pin to position the anchor pin in a forward position, or forward of the anchor pin to locate the anchor pin in a rearward position. The invention shifts the trimmable range of the drive, while maintaining vibration isolation characteristics available in conventional hydraulic trim systems.

U.S. Pat. No. 6,176,170 discloses a shock absorbing hydraulic actuator comprising a cylinder with first and second pistons slidably disposed therein. The first and second pistons are moveable relative to each other. A poppet is supported by the first piston and is moveable relative to the first piston. In response to hydraulic fluid pressure within a passage of the first piston, the poppet can be caused to move in a direction which opens a passage through the first piston to allow the first piston to move relative to the second piston in response to a shock impact such as that which can result from an outboard motor striking a submerged or floating object. The second piston remains in its original position. A bleed passage allows the first piston to resume its original position next to the second piston after the impact has occurred. This movement towards its original position is caused naturally by the weight of an object supported by the hydraulic actuator, such as an outboard motor.

U.S. Pat. No. 6,183,321 discloses an outboard motor having a pedestal that is attached to a transom of a boat, a motor support platform that is attached to the outboard motor, and a steering mechanism that is attached to both the pedestal and the motor support platform. A hydraulic tilting mechanism is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,156,709 discloses a calibration procedure that allows an upward maximum limit of tilt to be automatically determined and stored as an operator rotates a marine propulsion device relative to a marine vessel with a particular indication present. That indication can be a grounded circuit point which informs a microprocessor that at calibration procedure is occurring in relation to an upward trim limit. When the ground wire is removed or disconnected from the circuit point, the microprocessor knows that the calibration process is complete. During the rotation of the outboard motor or marine propulsion device in an upward direction, both the angular position of the outboard motor and the direction of change of a signal from a trim sensor are stored.

U.S. Pat. No. 7,942,711 discloses a method for controlling a marine propulsion trim system under two distinct modes of operation. A first mode operates hydraulic cylinders at a slower speed when the associated marine vessel is being operated at a speed above a predetermined threshold. For example, when the marine propulsion device is under load, such as when the marine vessel is operating on plane, the first mode of operation is used and the trim/tilt cylinders are operated at a slower speed. A second mode of operation is used when the marine propulsion system is being operated below a predetermined threshold. In other words, if the marine vessel is operating at a slow speed, the faster mode of operation is used. Similarly, if the marine vessel is being prepared for transport on a trailer, the very slow or non-existent speed of operation of the engine is used as an indicator which causes the second mode of operation to be employed.

U.S. Pat. No. 8,113,892 discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

Unpublished U.S. patent application Ser. No. 14/594,228, filed on Jan. 12, 2015, entitled "Systems and Methods for Controlling Trim Position of a Marine Propulsion Device on a Marine Vessel," discloses systems and methods for controlling trim position of a marine propulsion device on a marine vessel. The system comprises a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions. A controller is configured to adapt the amount of voltage to the electromagnet based upon at least one condition of the system.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a system is provided for controlling trim position of a marine propulsion device on a marine vessel. The system includes a trim actuator having a first end that is configured to couple to a marine propulsion device and a second end that is configured to couple to the marine vessel. The trim actuator is moveable between an extended position wherein the marine propulsion device is trimmed up with respect to the marine vessel, and a retracted position wherein the marine propulsion device is trimmed down with respect to the marine vessel. A controller controls position of the trim actuator between the extended position and the retracted position. A shock relief mechanism overrides position control by the controller and allows extension of the trim actuator upon the occurrence of an overpressure event. An arresting mechanism is provided, which when activated prevents extension of the trim actuator beyond a certain limit. The controller selectively activates the arresting mechanism in response to a determination that the marine propulsion device is being commanded in reverse.

According to another example of the present disclosure, a method for controlling trim position of a marine propulsion device on a marine vessel is provided. The method includes providing a trim actuator having a first end that is configured to couple to the marine propulsion device and a second end that is configured to couple to the marine vessel, the trim actuator being moveable between an extended position wherein the marine propulsion device is trimmed up with respect to the marine vessel and a retracted position wherein the marine propulsion device is trimmed down with respect to the marine vessel. The method includes controlling, with a controller, position of the trim actuator between the extended position and the retracted position. The method also includes providing a shock relief mechanism that overrides position control by the controller and allows extension of the trim actuator upon the occurrence of an overpressure event. The method further includes providing an arresting mechanism that when activated prevents extension of the trim actuator beyond a certain limit. The method additionally includes determining with the controller whether the marine propulsion device is being commanded in reverse, and if so, activating the arresting mechanism with the controller.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
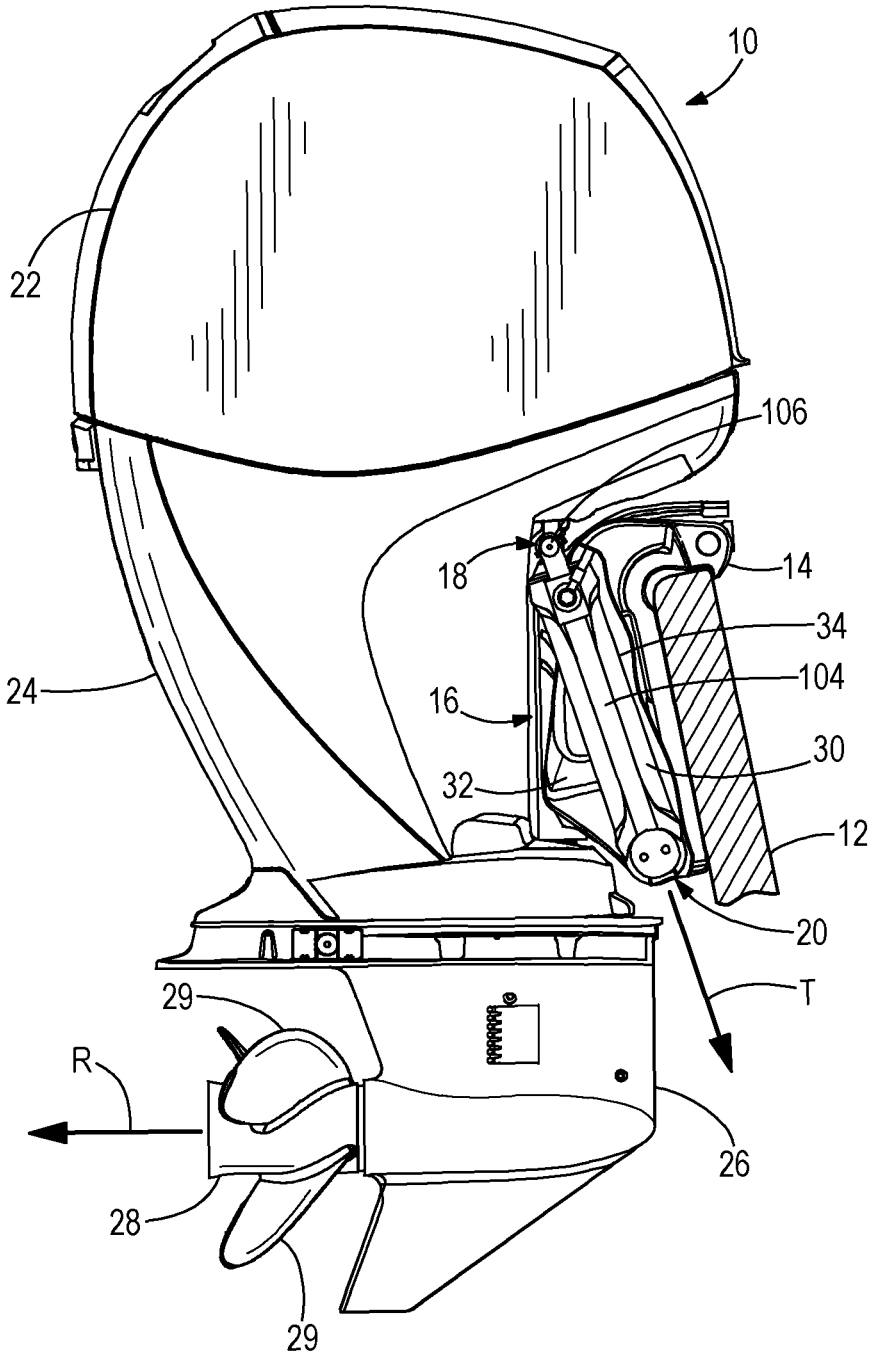
FIG. 1 illustrates an outboard motor according to one example of the present disclosure.

FIG. 1 illustrates a marine propulsion device 10, such as the outboard motor shown herein, coupled to a transom 12 (only part of which is shown) of a marine vessel. The exact configuration of the marine propulsion device 10 can vary from the example shown. For instance, the systems and methods of the present disclosure apply to stern drives as well as to outboard motors. In the example shown, the marine propulsion device 10 is connected to the transom 12 by way of a transom bracket 14 and a trim actuator 16. The trim actuator 16 has a first end 18 that is configured to couple to the marine propulsion device 10 and a second end 20 that is configured to couple to the marine vessel (at transom 12). The trim actuator 16 is moveable between an extended position wherein the marine propulsion device 10 is trimmed up with respect to the marine vessel and a retracted position wherein the marine propulsion device 10 is trimmed down with respect to the marine vessel. Examples of each of these positions are shown in FIGS. 2 and 1 of the above-incorporated '228 application, are well known to those having ordinary skill in the art, and will therefore not be described more fully herein.

The marine propulsion device 10 includes a powerhead 22 which conventionally contains an internal combustion engine for powering a driveshaft that extends through a midsection 24 of the marine propulsion device 10 and into a gear case 26, where it connects to a propeller shaft that rotates a propeller 28. By rotating the propeller 28 in different directions (clockwise or counterclockwise), the propeller 28 can be made to produce either a forward or reverse thrust, depending on the orientation of the propeller blades 29. This thrust can be used to propel the marine vessel in forward or reverse. Additionally, when the marine vessel is operated in a joysticking or station keeping (electronic anchoring) mode, the marine propulsion device 10 may be commanded to produce forward or reverse thrusts at varying steering angles in order to maneuver the vessel according to commands from a joystick, or in order to maintain the marine vessel at a particular geographic location, respectively. In modes such as these, the marine propulsion device 10 is commanded to certain steering angles, to produce certain magnitudes of thrust, and to produce thrust in a forward or reverse direction, in order to accomplish a desired movement of the marine vessel. More than one marine propulsion device 10 can be provided to achieve the desired movement, although only one device is shown herein.

The propeller 28 can produce a reverse thrust by rotation of the propeller 28 to push water forward with respect to the gear case 26. Consequently, the water pushes rearwardly against each propeller blade 29, propelling the marine vessel rearwardly with respect to the body of water in which it is operating. The water thus applies force on the marine propulsion device 10 by way of the propeller blades 29, which force acts in the direction shown by arrow R. This produces a corresponding reaction of the trim system, including the trim actuator 16, which manifests itself as a tensile load T. More specifically, in the example shown, the trim actuator 16 comprises a piston-cylinder 30 and a pedestal 32, and the tensile load T acts on the piston-cylinder 30. The tensile load T is a reaction to the rearward force R acting on the marine propulsion device 10 near the gear case 26, as the force R tends to pull the marine propulsion device 10 away from the transom 12, to which the marine propulsion device 10 is coupled via the trim actuator 16. Only one piston-cylinder 30 is shown on the starboard side of the marine propulsion device 10; however, it should be understood that a similar piston-cylinder is provided on the opposite (port) side of the marine propulsion device 10. Only one piston-cylinder will be described further below, but it should be understood that this description applies equally to both piston-cylinders.

Figure 2:
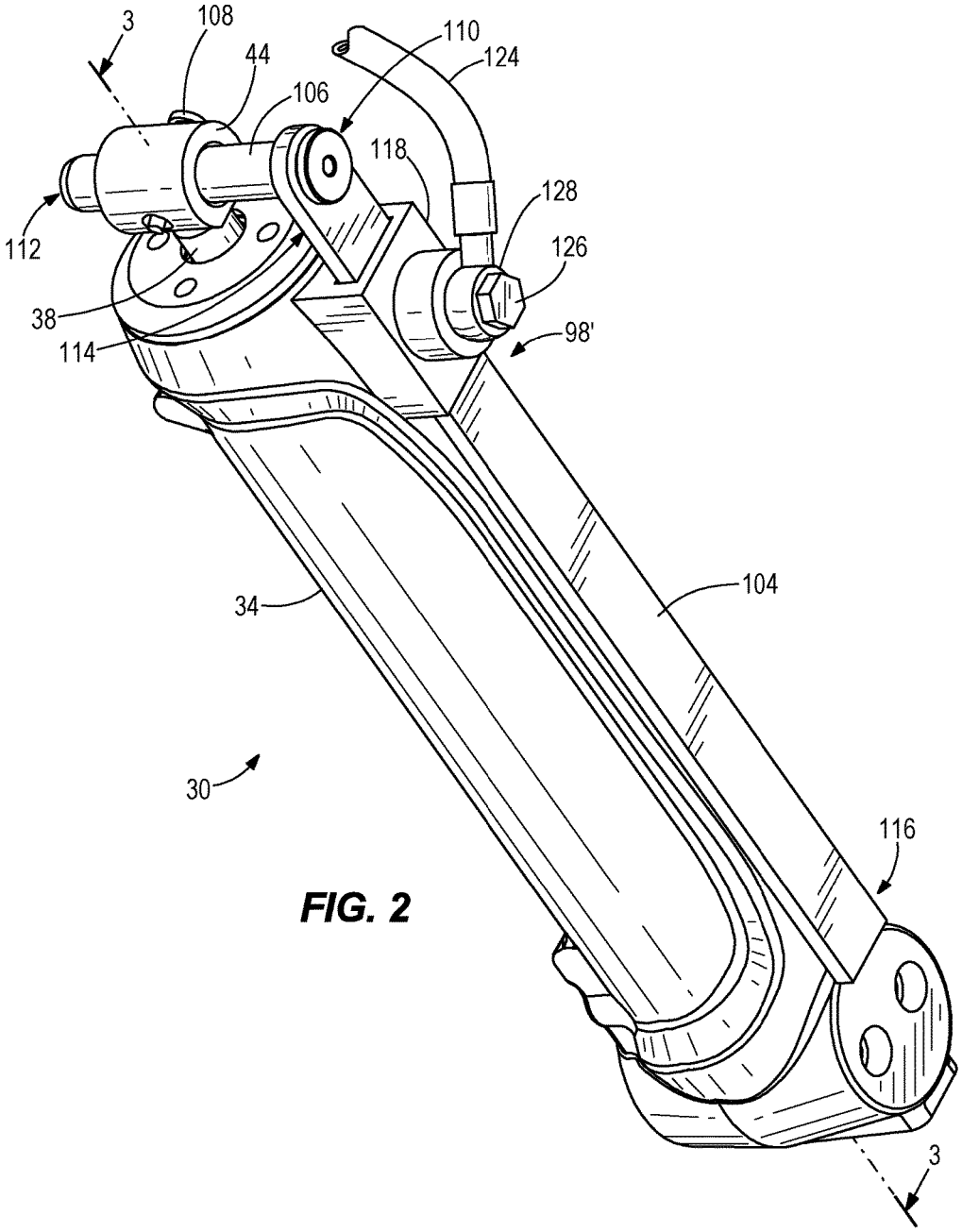
FIG. 2 illustrates a trim actuator according to one example of the present disclosure.
Figure 3:
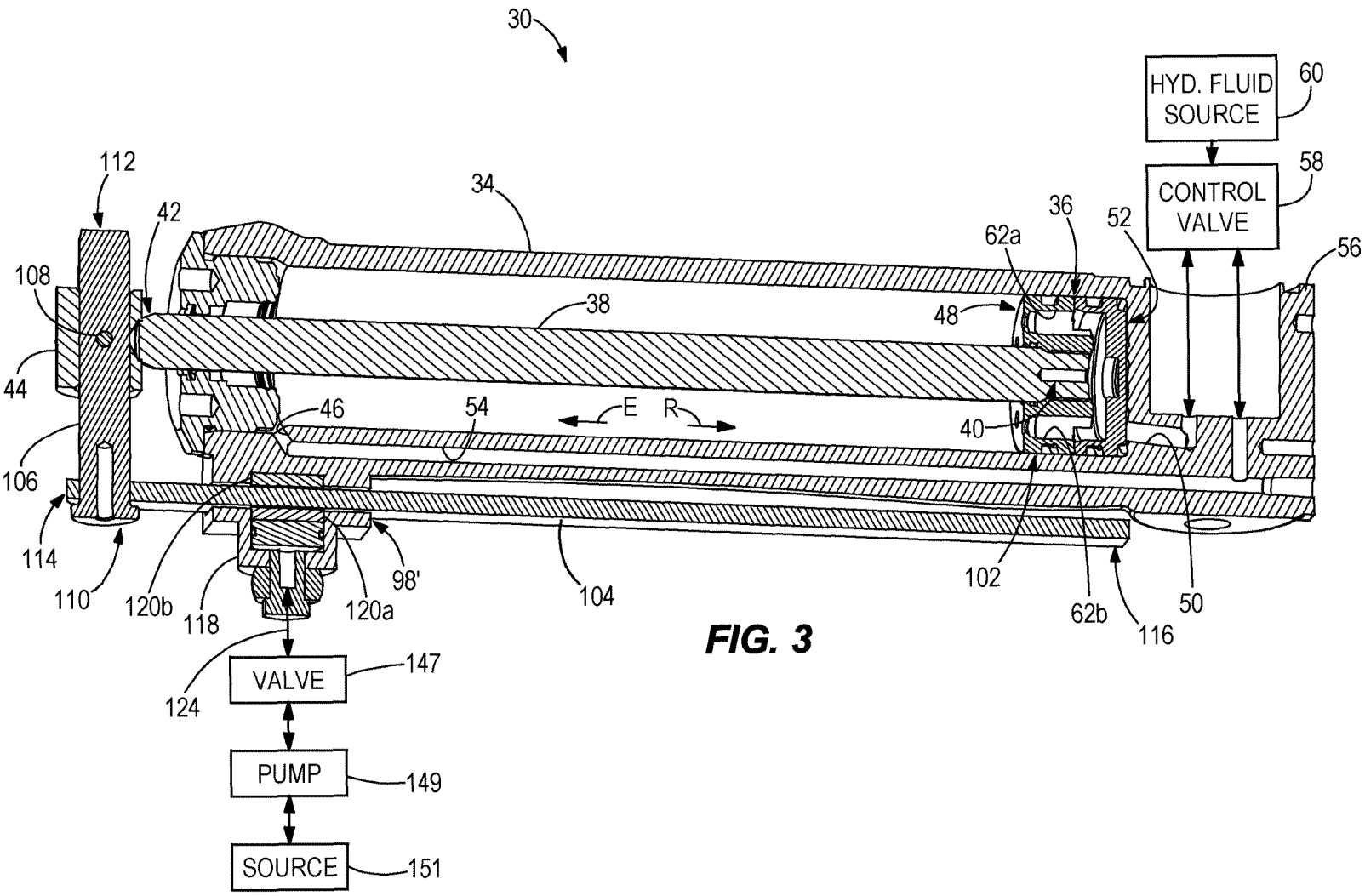
FIG. 3 illustrates a cross section of the trim actuator of FIG. 2, taken along the line 3-3.

FIGS. 2 and 3 depict one example of a piston-cylinder 30 according to the present disclosure. The piston-cylinder 30 includes a cylinder 34 and a piston 36 that reciprocates back and forth in the cylinder 34, as shown at arrows E. R. A trim rod 38 is coupled to the piston 36 and extends from one end of the cylinder 34. The trim rod 38 has a first end 40 that is connected to the piston 36 and a second end 42 that extends from the cylinder 34. A rod end 44 is disposed on the second end 42 and is configured for connection to the marine propulsion device 10. Movement of the piston 36 in the direction of arrow E causes the trim rod 38 to further extend from the cylinder 34 and thus raises the marine propulsion device 10 into a trimmed up position. Movement of the piston 36 in the direction of arrow R causes the trim rod 38 to retract into the cylinder 34 and thus lowers the marine propulsion device 10 into the trimmed down position shown in FIG. 1. Similar to the piston-cylinders disclosed in the incorporated U.S. Pat. No. 6,183,321, the piston-cylinder 30 has a first inlet 46 to the cylinder 34 on a rod-side 48 of the piston 36. The piston-cylinder 30 also has a second inlet 50 to the cylinder 34 on a cylinder-side 52 of the piston 36. The first inlet 46 extends from one end of the piston-cylinder 30 to the opposite end of the piston-cylinder 30 via an axial passageway 54 in the sidewall of the cylinder 34. The second inlet 50 axially extends through the end cap 56 of the cylinder 34 to the noted cylinder-side 52 of the piston 36.

A bidirectional control valve, shown here schematically at 58, controls flow of hydraulic fluid from a hydraulic fluid source 60 to the rod-side 48 of the piston 36 and the cylinder-side 52 of the piston 36. For example, the hydraulic fluid source 60 supplies hydraulic fluid to the hydraulic actuator (piston-cylinder 30) via the first inlet 46 to the cylinder 34 on the rod-side 48 of the piston 36, and via the second inlet 50 to the cylinder 34 on the cylinder-side 52 of the piston 36. The control valve 58 controls flow of the hydraulic fluid to the rod-side 48 of the piston 36 and the cylinder-side 52 of the piston 36. The control valve may also optionally control fluid flow out of the cylinder 34. The control valve 58 is a conventional feature, which is more fully described in the incorporated U.S. Pat. No. 6,183,321. Flow of the fluid to the rod-side 48 of the piston 36 causes the piston 36 to move in the direction of arrow R such that the trim rod 38 further retracts into the cylinder 34 and the marine propulsion device 10 is trimmed downwardly. Flow of hydraulic fluid to the cylinder-side 52 of the piston 36 causes the piston 36 to move in the direction of arrow E such that the trim rod 38 further extends from the cylinder 34 and the marine propulsion device 10 is trimmed upwardly.

The piston 36 includes relief passages 62*a*, 62*b* that allow flow of the hydraulic fluid past the piston 36 during overpressure events, such as for example due to an underwater impact (log or rock strike) to the marine propulsion device 10, or due to any other large force on the marine propulsion device 10, such as a thrust load and/or the like. The relief passages 62*a*, 62*b* allow flow past the piston 36 as the piston 36 moves in the direction of arrows E, R, i.e. as the trim actuator 16 moves into and out of the retracted and extended positions. (This movement is caused by the force of the overpressure event, and is independent of controlled provision of fluid through the inlets 46, 50.) In this way, the relief passages 62*a*, 62*b* act as a shock relief mechanism, allowing the piston-cylinder 30 to absorb or counteract the effects of an overpressure event. For example, a first relief passage 62*a* conveys the hydraulic fluid from the rod-side 48 of the piston 36 to the cylinder-side 52 of the piston 36 to counteract sudden high pressure on the rod-side 48. A second relief passage 62*b* conveys the hydraulic fluid from the cylinder-side 52 of the piston 36 to the rod-side 48 of the piston 36 to counteract suddenly high pressure on the cylinder-side 52 and/or to return fluid to the rod-side 48 after high pressure on the rod-side 48 has subsided.

Figure 7:
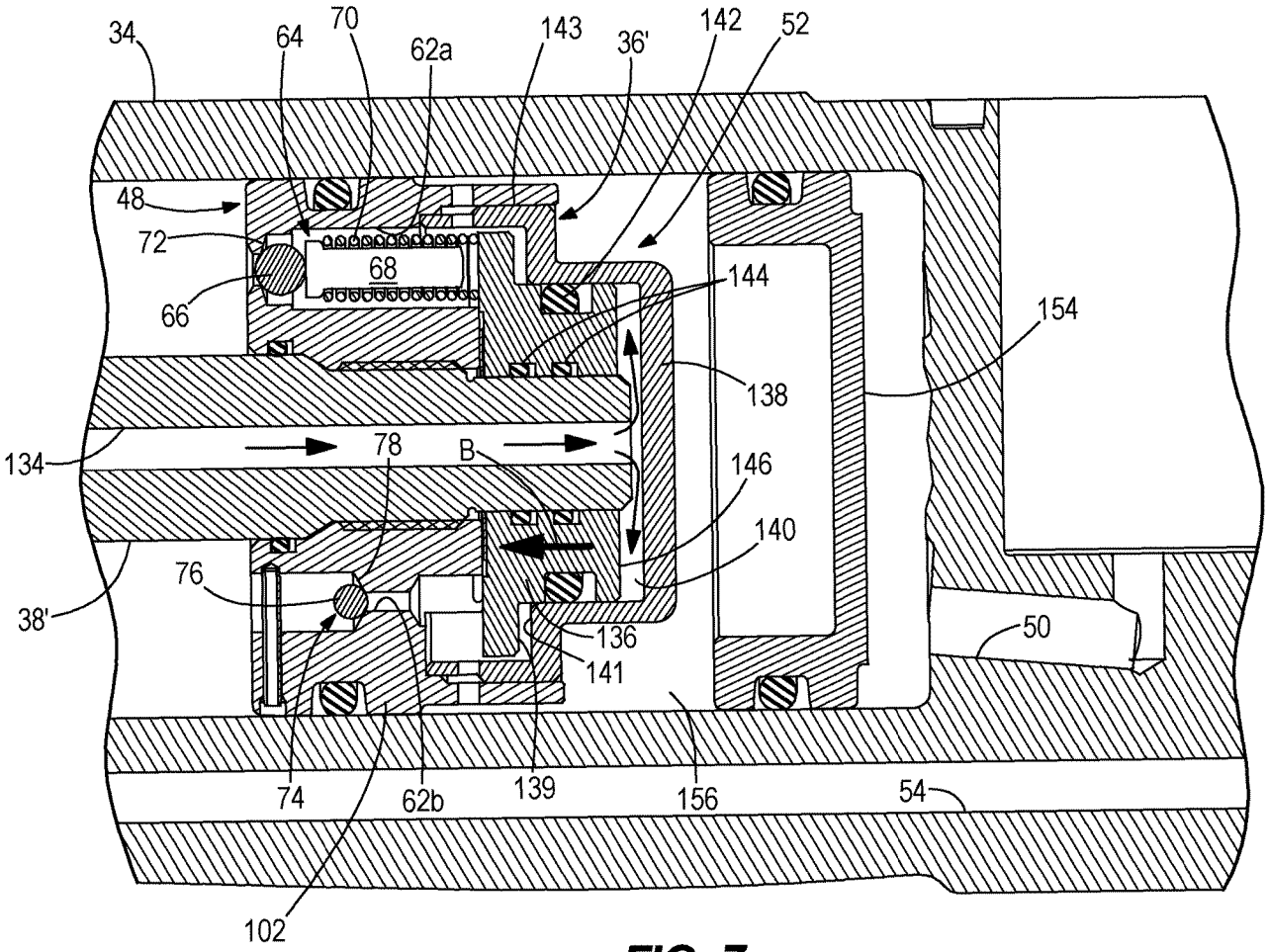
FIG. 7 illustrates a close up of a piston area of the trim actuator of FIG. 6, wherein the piston is in a braked position.

Each of the first and second relief passages 62*a*, 62*b* may have a valve arrangement therein for controlling flow of the hydraulic fluid through the first and second relief passages 62*a*, 62*b*. While an exemplary valve arrangement will be described with respect to the embodiment of FIG. 7 due to the detailed view shown therein, the same valve arrangement could be provided in the relief passages 62*a*, 62*b* in the embodiment of FIG. 3. Additionally, the type and configuration of each valve arrangement can vary from that which is shown and described. Turning to the example of FIG. 7, a first valve 64 is disposed in the first relief passage 62*a*. The first valve 64 is a check valve and includes a ball 66 that is biased into a seated closed position (as shown in FIG. 7) by a plunger 68 and spring 70. During an overpressure event in an aftward direction on the marine propulsion device 10, such as a log strike, the hydraulic fluid on the rod-side 48 of the piston 36' can develop a pressure that is larger than a bias force of the spring 70, and thus the ball 66 is moved to an open position wherein the ball is separated from its seat 72 and flow of hydraulic fluid from the rod-side 48 of the piston 36' to the cylinder-side 52 of the piston 36' is permitted. Conversely, when the hydraulic fluid on the rod-side 48 of the piston 36' develops a pressure that is smaller than the bias force of the spring 70, the ball 66 is biased by the spring 70 into the closed position shown in FIG. 7, wherein the ball 66 is seated on its seat 72 and flow of hydraulic fluid from the rod-side 48 of the piston 36' to the cylinder-side 52 of the piston 36' is prevented.

A second valve 74 is disposed in the second relief passage 62*b*. The second valve 74 is also a check valve and includes a ball 76 that is biased into a seated, closed position (shown in FIG. 7) by the pressure of the hydraulic fluid on the rod-side 48 of the piston 36'. During an overpressure event in a forward direction on the marine propulsion device 10, the hydraulic fluid on the cylinder-side 52 of the piston 36' develops a pressure that is greater than the pressure of the hydraulic fluid on the rod-side 48 of the piston 36', and thus the ball 76 is biased into an unseated, open position wherein the ball 76 is separated from its seat 78 and flow of hydraulic fluid from the cylinder-side 52 of the piston 36' to the rod-side 48 of the piston 36' is permitted. Conversely, when the hydraulic fluid on the cylinder-side 52 of the piston 36' has a pressure that is less than the pressure of the hydraulic fluid on the rod-side 48 of the piston 36', the ball 76 is biased into the seated, closed position shown in FIG. 7, wherein flow of hydraulic fluid from the cylinder-side 52 of the piston 36' to the rod-side 48 of the piston 36' is prevented.

It should be noted that the piston 36' may actually include many relief passages of both types described with respect to the relief passages 62*a*, 62*b*. The passages can be spaced circumferentially around the trim rod 38' and can be provided in a pattern such that no two passages of the same type 62*a* or 62*b* are next to one another. Each type of passage may be provided with a valve 64, 74 as described herein. The spring force of the valves 64 can be designed to require a certain pressure to build on the rod-side 48 of the piston 36' before the valves 64 will open. The occurrence of an external event that causes a pressure high enough to force the valves 64 open is considered to be an overpressure event.

Details regarding certain causes of overpressure events and how they are counteracted by the relief passages 62*a*, 62*b* and valve arrangements provided therein will be described further herein below. In the meanwhile, it is helpful to describe a control system associated with the trim actuator 16 and shock relief mechanism for contextual purposes.

Figure 9:
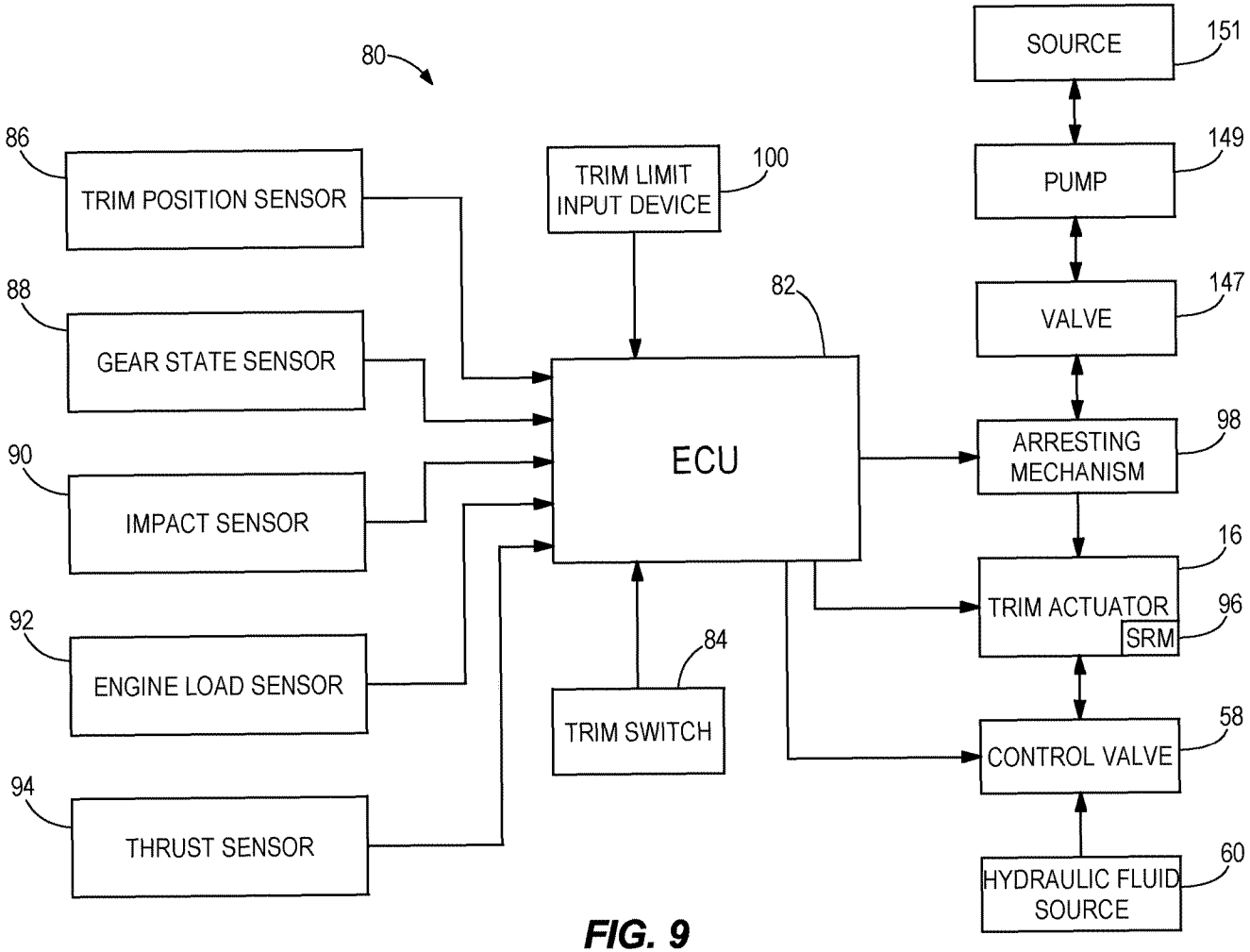
FIG. 9 schematically illustrates one example of a trim control system and its inputs and outputs, according to the present disclosure.

FIG. 9 depicts one example of a system 80 for controlling trim position of the marine propulsion device 10 using at least one of the exemplary trim actuators described herein. The system 80 includes the noted trim actuator 16, which can include the two piston-cylinders 30 and/or another variant thereof. The system 80 also includes pressurized hydraulic fluid source 60, which can include a pump for providing hydraulic fluid to the piston-cylinder 30 as described herein above.

The system 80 also includes a controller 82 in the form of an electronic control unit (ECU) that is programmable and includes a computer processor, software, memory (i.e. computer storage) and an associated input/output (interface) device. The processor loads and executes software, which can be stored in the memory. Executing the software controls the system 80 to operate as described herein in further detail below. The processor can comprise a microprocessor and/or other circuitry that receives and executes software. The processor can be implemented within a single device, but can also be distributed across multiple processing devices and/or subsystems that cooperate in executing program instructions. Examples include general purpose central processing units, application specific processors, and logic devices, as well as any other processing device, combination of processing devices, and/or variations thereof. The controller 82 can be located anywhere with respect to the marine propulsion device 10 and associated marine vessel and can communicate with various components of the system 80 via wired and/or wireless links, examples of which are shown in FIG. 9. The controller 82 can have one or more microprocessors that are located together or remotely from each other in the system 80 or remotely from the system 80.

The memory can include any storage media that is readable by the processor and capable of storing software. The memory can include volatile and/or non-volatile removable and/or non-removable media implemented in any method or technology for storage of information, such as computer readable instructions, data structures, program modules, or other data. The memory can be implemented as a single storage device but may also be implemented across multiple storage devices or subsystems. The memory can further include additional elements such as a controller capable of communicating with the processor. Examples of storage media include random access memory, read only memory, magnetic discs, optical discs, flash memory discs, virtual and/or non-virtual, magnetic cassettes, magnetic tape, magnetic disc storage, or other magnetic storage devices, or any other medium which can be used to store the desired information that may be accessed by an instruction execution system, as well as any combination or variation thereof, or any other type of storage media. In some implementations, the storage media can be non-transitory storage media.

The input/output device can include any one of a variety of conventional computer input/output interfaces for receiving electrical signals for input to the processor and for sending electrical signals from the processor to various components of the system. The controller 82, via the noted input/output device, communicates with components of the marine propulsion device 10 via communication links, which as mentioned herein above can be wired or wireless links. As explained further herein below, the controller 82 is capable of monitoring and controlling operational characteristics of the marine propulsion device 10 by sending and/or receiving control signals via the various links shown in FIG. 9. Although the links are each shown as a single link, the term "link" can encompass one or a plurality of links that are each connected to one or more of the components of the system 80.

The controller 82 can be programmed to control the control valve 58 to thereby adjust the trim position of the marine propulsion device 10. Upon input to the controller 82 via, for example, a trim switch 84 located at the helm of the marine vessel, the controller 82 controls position of the trim actuator 16 between the extended position and the retracted position by actuating the control valve 58 to cause extension or retraction of the piston-cylinder 30, as described herein above. As noted, a shock relief mechanism 96, such as the relief passages 62*a*, 62*b* and their associated valves 64, 74 described above, can override position control by the controller 82. The shock relief mechanism 96 allows extension of the trim actuator 16 upon the occurrence of an overpressure event, also as described herein above.

The system 80 also includes various sensors that are configured to sense operational characteristics of the system 80 and convey such information in the form of electrical signals to the controller 82. For example, a trim position sensor 86 is configured to sense a current trim position of the marine propulsion device 10 and provide this information to the controller 82. The type of trim position sensor 86 can vary, in certain examples; the trim position sensor 86 includes a conventional encoder positioned along a trim axis of the marine propulsion device 10.

The system 80 can include a gear state sensor 88 that is configured to sense a current gear state (e.g. position) of a transmission associated with the marine propulsion device 10. In some examples, the gear state sensor 88 senses a current position of a shift linkage associated with a conventional shift/throttle lever. The gear state that is sensed by the gear state sensor 88 is communicated to the controller 82. The type and location of gear state sensor 88 can vary. In some examples, the gear state sensor 88 includes a potentiometer and an electronic converter, such as an analog-to-digital converter that outputs discreet analog to digital (ADC) counts that each represents a position of the noted shift linkage. Such potentiometer and electronic converter combinations are known in the art and commercially available, for example, from CTS Corporation. In other examples, the gear state sensor 88 senses a current position of a joystick being used to control maneuvering of the vessel. In a further example, the gear state sensor 88 is not a physical sensor at all, but a software-implemented algorithm that determines whether the marine propulsion device 10 is being commanded in reverse according to a joysticking or stationkeeping mode.

The system 80 can also include an underwater impact sensor 90 that is configured to sense a future impact to the marine propulsion device 10 and communicate this information to the controller 82. The type of underwater impact sensor 90 can vary and can include, for example, a conventional sonar system, laser system, and/or the like.

The system 80 can include an engine load sensor 92 that is configured to sense a current engine load of the marine propulsion device 10 and communicate this information to the controller 82. The type of engine load sensor 92 can vary. In certain examples, the engine load sensor 92 is comprised of an engine speed sensor that is configured to sense a current engine speed of the marine propulsion device 10, in combination with a throttle valve position sensor that senses position of the throttle valve associated with the internal combustion engine on the marine propulsion device 10. In certain examples, the engine speed sensor senses rotations per minute (RPM) of the internal combustion engine. The type and location of the engine speed sensor can vary and in some examples is a Hall Effect or variable reluctance sensor located near the encoder ring of the engine. Such an engine speed sensor is known in the art and commercially available, for example, from CTS Corporation or Delphi. The type and location of the throttle position sensor can vary. In some examples, the throttle position sensor is a wiper-type sensor, which can be located on the body of the throttle valve and is commercially available from Cooper Auto or Walbro. Engine load can be provided to the controller 82 via comparison of the outputs of the throttle potion sensor and engine speed sensor.

The system can include a thrust sensor 94 configured to sense a thrust produced by the marine propulsion device 10 and communicate this information to the controller 82. The type and packaging of the thrust sensor 94 can vary, and in some examples includes a strain gauge or a load cell that is coupled around a propeller shaft of the marine propulsion device 10. Alternatively, the thrust sensor 94 is a pressure transducer on the trim system. Alternatively, the thrust sensor 94 includes sensors for sensing engine speed, boat speed, and reverse gear selection, and uses these values to calculate an approximate amount of thrust. The engine speed sensor can be one of the types mentioned above as being part of the engine load sensor 92. The boat speed sensor can be a pitot tube or paddle wheel sensor, or a reading taken from a GPS-enabled device comparing time and global position. The gear state can be sensed by any of the sensors described above with respect to the gear state sensor 88.

In current systems equipped with a shock relief mechanism 96, such as the relief passages 62*a*, 62*b* and their associated valves 64, 74, reverse thrust from a marine propulsion device 10 is limited by the set up of the trim actuator 16. This is because, as described above, the trim actuator 16 is designed to release hydraulically (extend) to allow the marine propulsion device 10 to trim up during underwater impacts that cause overpressure events. However, high reverse thrust loads produced by the propeller 28 can also cause overpressure events, and thus cause the trim actuator 16 to release (extend) in the trimmed up direction. In the latter instance, this release is not desirable, especially given the joysticking and stationkeeping modes described above, which often require the propulsion device 10 to produce high reverse thrust in order to accomplish certain maneuvering of the marine vessel. For example, if the reverse thrust is enough to trim the marine propulsion device 10 up so much that the gear case 26 leaves the water, the operator loses authority over the vessel.

Through research and development, the present inventors realized that it would be desirable to increase the reverse thrust capability of a marine propulsion device 10 without affecting its capability to trim up in the event of a non-thrust induced overpressure event (e.g. a log strike). Therefore, returning to FIG. 9, the present inventors developed an arresting mechanism 98 that when activated prevents extension of the trim actuator 16 beyond a certain limit. The controller 82 selectively activates the arresting mechanism 98 in response to a determination that the marine propulsion device 10 is being commanded in reverse. Using an arresting mechanism 98 presents a better alternative to that of, for example, modifying the relief valves 64, 74 to release at higher pressures in order to increase the amount of reverse thrust that the system will carry, as this can degrade the function of the shock relief mechanism 96.

Figure 8:
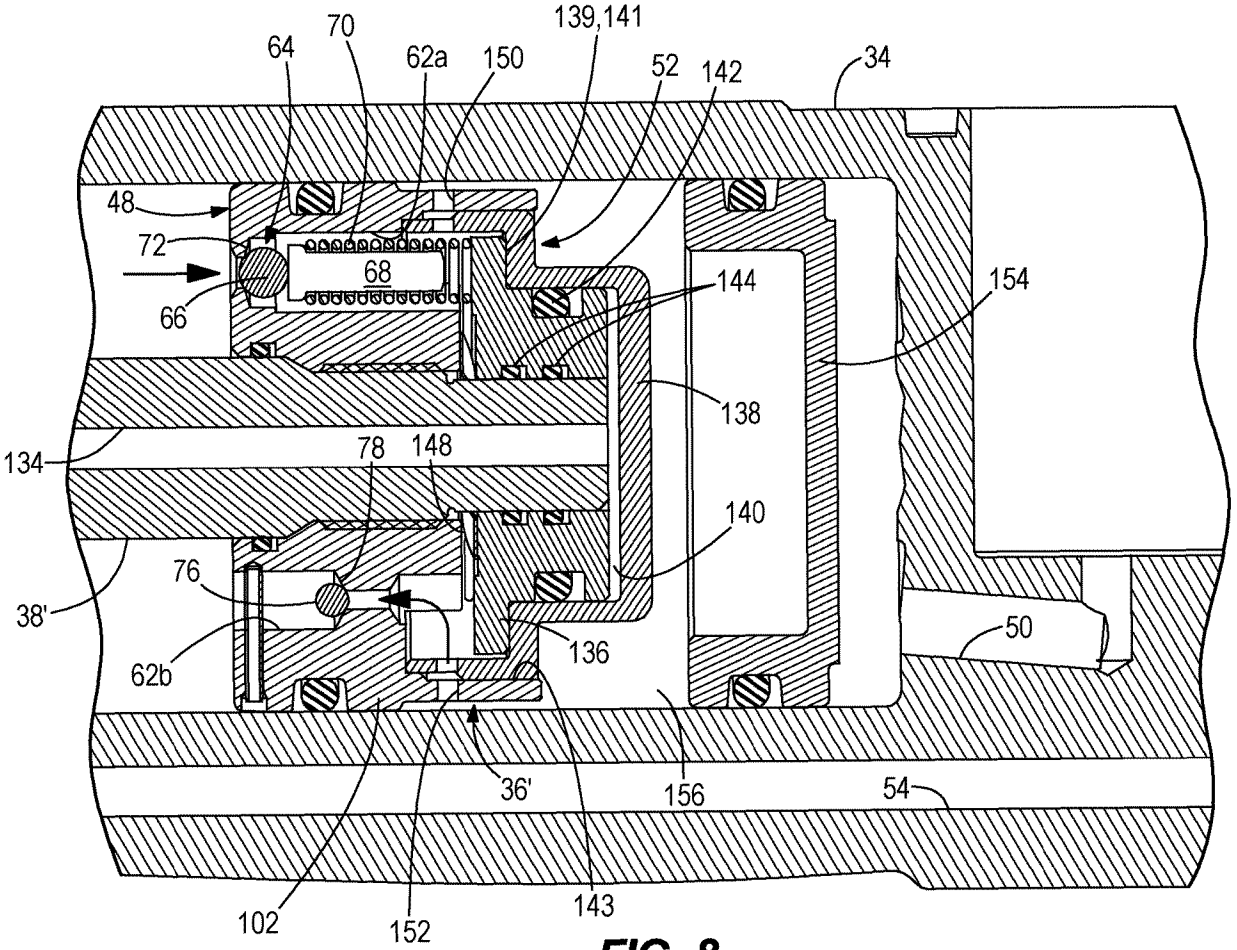
FIG. 8 illustrates a close up of the piston area of the trim actuator of FIGS. 6 and 7, wherein the piston is in a non-braked position.

In the event that the shock relief mechanism 96 is triggered due to high reverse thrust, the arresting mechanism 98 can be designed to prevent the effect of the shock relief mechanism 96 altogether, or to limit the extent to which the trim actuator 16 can extend due to the shock relief functionality. Two examples of the arresting mechanism 98 will be described herein, one of which is shown in FIGS. 1-5, and the other of which is shown in FIGS. 6-8. In FIGS. 1-5, the arresting mechanism 98' acts on the piston-cylinder 30 exterior of the cylinder 34. In the example of FIGS. 6-8, the arresting mechanism 98" acts on the piston-cylinder 30 interior to the cylinder 34.

In general, the arresting mechanisms 98 that will be described further herein below can be activated based on a number of different sensed conditions that indicate to the controller 82 that the marine propulsion device 10 is being commanded in reverse. For example, the controller 82 may activate the arresting mechanism 98 in response to the marine propulsion device 10 being placed in reverse gear, thus preventing the trim actuator 16 from trimming up in response to large reverse thrust loads during reverse gear operation. Whether the marine propulsion device 10 has been placed in reverse gear can be determined according to the information provided by the gear state sensor 88. Additionally, the controller 82 can be configured to deactivate the arresting mechanism 98 if the current gear state is a forward gear, thus facilitating trail over (pivoting of the marine propulsion device 10) during collision with underwater structures, such as logs or rocks.

In another example, the controller 82 activates the arresting mechanism 98 not only when the marine propulsion device 10 is placed in reverse gear, but also in response to the marine propulsion device 10 being commanded to produce a reverse thrust having a magnitude that exceeds a certain threshold. The sensed or calculated magnitude of thrust could be provided to the controller 82 by the thrust sensor 94. In other examples, the controller 82 approximates the thrust using a measure of the engine load from engine load sensor 92, coupled with a determination that the marine propulsion device 10 has been placed in reverse gear according to information from the gear state sensor 88.

In one example, the thrust threshold at which the controller 82 activates the arresting mechanism 98 corresponds to a force on the marine propulsion device 10 that would otherwise cause an overpressure event and activate the shock relief mechanism 96. Using the shock relief mechanism in the form of the relief passageways shown in FIG. 7 as an example, the reverse thrust threshold may correspond to a force that is capable of overcoming the spring force of the spring 70 within the first relief passage 62*a* and allowing fluid to flow from the rod-side 48 to the cylinder-side 52 of the piston 36'. By setting a reverse thrust threshold that corresponds to the force necessary to overcome the spring force, it can be ensured that the arresting mechanism 98 will only activate when the marine propulsion device 10 produces enough reverse thrust that the shock relief mechanism 96 could potentially be triggered to extend the trim actuator 16. The shock relief mechanism 96 is therefore able to function while the marine propulsion device 10 produces levels of reverse thrust that are lower than the certain threshold.

In certain examples, an engine speed sensor (not shown) is configured to sense the current engine speed of the marine propulsion device 10 and communicate this information to the controller 82, which in turn is configured to control the arresting mechanism 98 based upon, for example, a protocol saved in the memory. In some examples the controller 82 can be programmed to deactivate the arresting mechanism 98 when the current engine speed is below an engine speed threshold, when reverse thrust is unlikely to be high enough to cause the propulsion device 10 to tilt up inadvertently. In certain examples, the controller 82 can be configured to actuate the arresting mechanism 98 when the current engine speed is above an engine speed threshold, and reverse thrust is therefore likely to be much higher.

In other examples, different fail safes can be provided to the system 80 in order to deactivate the arresting mechanism 98, even when the marine propulsion device 10 is operating in reverse, and allow the marine propulsion device 10 to be trimmed up in the event of an overpressure event, especially one such as a log strike. For example, the underwater impact sensor 90 could be used to deactivate the arresting mechanism 98, such that when the controller 82 receives a signal from the underwater impact sensor 90 that an impact is about to occur, the arresting mechanism 98 may be deactivated, thereby allowing the trim actuator 16 to move to permit pivoting movement of the marine propulsion device 10, to limit damage thereto during collision with underwater structures such as logs, rocks and/or the like. This can be done no matter the magnitude of reverse thrust the marine propulsion device 10 is producing, as it may be more desirable to avoid a log strike than to avoid accidental activation of the shock relief mechanism 96 and subsequent trimming up of the marine propulsion device 10.

In one example, in which the trim actuator 16 is a hydraulic actuator and includes the above-noted cylinder 34, piston 36 that reciprocates back and forth in the cylinder 34, and trim rod 38 that is coupled to the piston 36 and extends from the cylinder 34, the arresting mechanism 98 may prevent the piston 36 and trim rod 38 from moving more than a certain extent with respect to the cylinder 34. In some examples, the system 80 can further include a trim limit input device 100, which allows the operator of the marine vessel to select the certain limit beyond which the trim actuator 16 cannot extend (e.g. the certain limit beyond which the trim rod 38 may not extend from the cylinder 34). A feedback system, using trim position sensed by the trim position sensor 86, can be used in order to determine when the arresting mechanism 98 should be activated in order to stop further movement of the trim rod 38 with respect to the cylinder 34 because the trim limit has been reached. In certain examples, the controller 82 can be configured to actuate the arresting mechanism 98 when the current trim position of the marine propulsion device 10 exceeds a trim position threshold set by the operator via the trim limit input device 100, regardless of the gear state of the marine propulsion device. In this way, the operator can stop the marine propulsion device 10 along its path as it trims up due to the effects of the shock relief mechanism 96, and hold the marine propulsion device 10 at the chosen trim angle, which may be one that prevents the gear case 26 from leaving the water. In other examples, the controller 82 can be configured to actuate the arresting mechanism 98 when the current trim position of the marine propulsion device 10 exceeds the trim position threshold, provided that the other conditions for activation of the arresting mechanism 98 are also met (e.g. reverse gear and/or reverse thrust of greater than a certain threshold). In other examples, the arresting mechanism 98 may be designed to limit extension of the trim actuator 16 beyond a certain limit without requiring this limit to be input via the trim limit input device 100.

Returning to FIGS. 2 and 3, the piston-cylinder 30 shown therein and its arresting mechanism 98' will be further described. As noted above, the piston 36 comprises a shock relief mechanism, including a shock relief part 102 having the noted relief passages 62*a*, 62*b* that convey hydraulic fluid past the piston 36 as the trim actuator 16 is forced by an overpressure event into or out of the extended and retracted positions. Again, although check valves are not shown in the relief passages 62*a*, 62*b* in FIG. 3, the same types of check valves as shown in FIG. 7 could be employed. Alternatively, flap valves or other types of valves could be used. In the example of FIGS. 2 and 3, the arresting mechanism 98' acts on the trim rod 38 outside of the cylinder 34. The arresting mechanism 98' comprises a brake rod 104 coupled to the trim rod 38, for example by way of a shaft 106 extending through the rod end 44 and held thereto, for example, by a cotter pin 108. A first end 110 of the shaft 106 is coupled to a first end 114 of the brake rod 104, a middle area of the shaft 106 is coupled to the rod end 44 via the cotter pin 108, and a second end 112 of the shaft 106 is coupled to the marine propulsion device 10, for example by way of a swivel bracket or similar type of bracket, which is not shown herein. However, the first end 110 of the shaft 106 is shown in FIG. 1, indicating where such connection to the marine propulsion device 10 via the second, opposite end 112 would be made. The connection of the second end 112 of the shaft 106 to the marine propulsion device 10 can be made in the same way that a shaft couples a trim actuator 16 to a marine propulsion device 10 in known assemblies.

In this example, the brake rod 104 comprises a long rod that extends approximately the same length as the piston-cylinder 30. This allows the brake rod 104 to extend and retract along with the trim rod 38 as the trim rod 38 is extended and retracted, for example by way of provision of hydraulic fluid to the rod-side 48 or cylinder-side 52 of the piston 36 via the first and second inlets 46, 50 and control valve 58. The brake rod 104 can also move when the trim rod 38 moves in response to an overpressure event. The brake rod 104 is shown as being rectangular, but could take other shapes instead. As described above, the first end 114 of the brake rod 104 is coupled to the shaft 106, such as by the shaft 106 extending through a hole in the first end 114 of the brake rod 104. A second end 116 of the brake rod 104 is allowed to hang free, and to reciprocate back and forth outside the cylinder 34. In other examples, guide plates could be provided along the cylinder 34 that would guide the brake rod 104 along its reciprocating path. The arresting mechanism 98' may further include a brake situated within a brake housing 118. In the example shown herein, the brake includes brake pads 120*a*, 120*b* that selectively prevent movement of the brake rod 104. For example, the brake pads 120*a*, 120*b* prevent movement of the brake rod 104 in response to an activation signal from the controller 82 (see FIG. 9). Preventing movement of the brake rod 104 thereby also prevents movement of the trim rod 38, which as mentioned above is coupled to the brake rod 104 via the shaft 106 and rod end 44.

Figure 4:
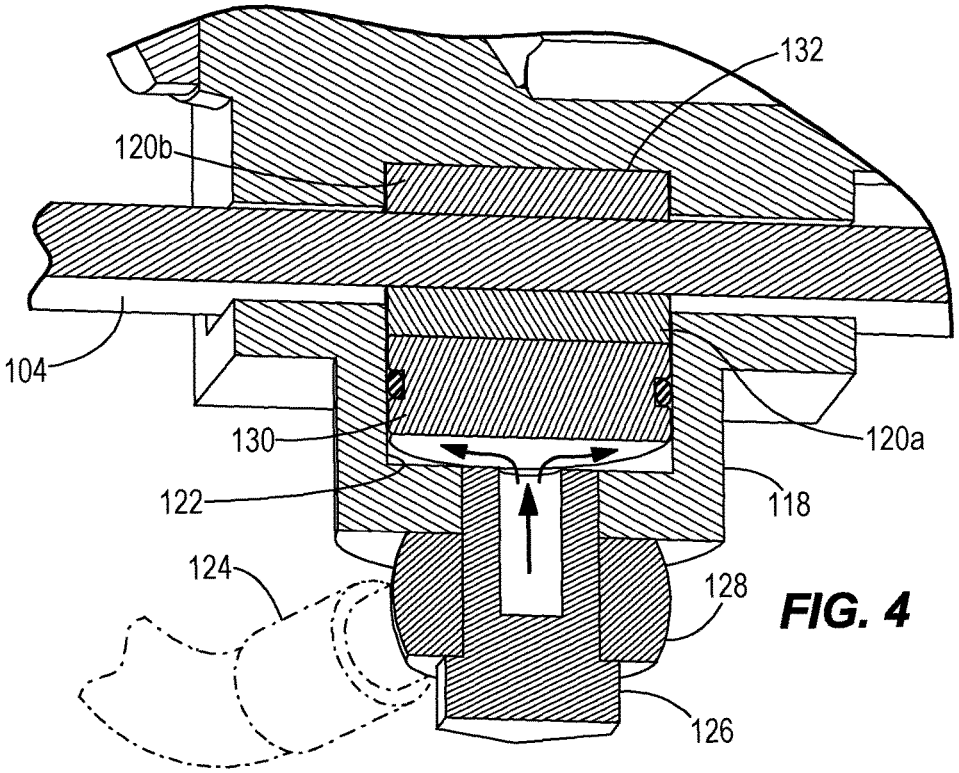
FIG. 4 illustrates a close up view of a braking mechanism of the trim actuator of FIGS. 2 and 3 in a braked position.
Figure 5:
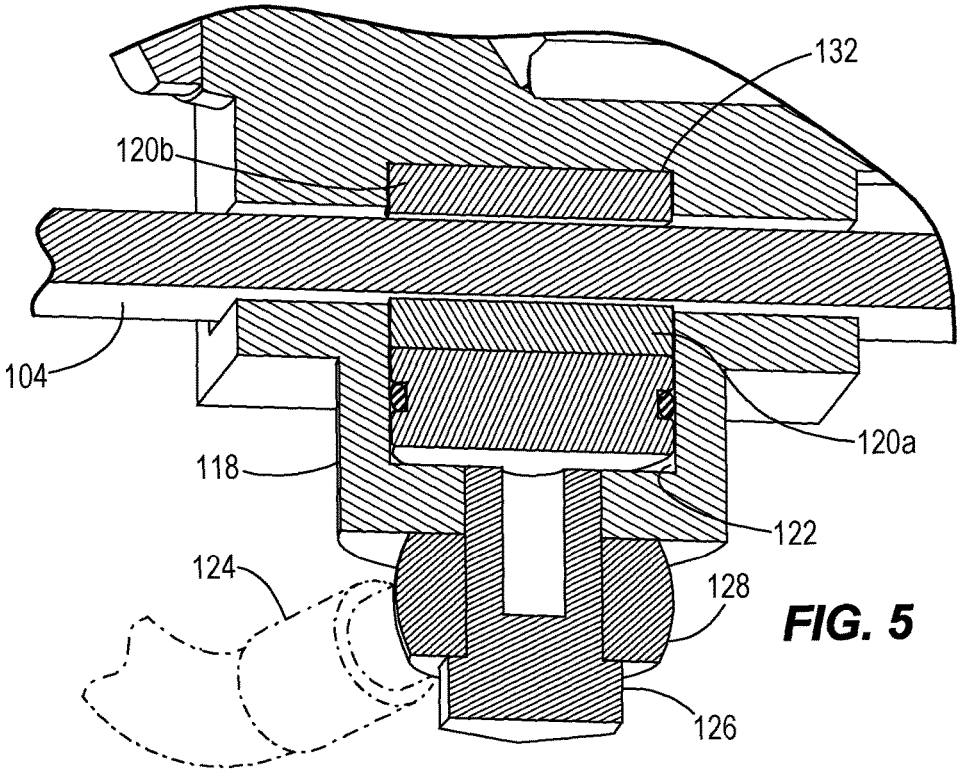
FIG. 5 illustrates the braking mechanism of FIGS. 2-4 in a non-braked position.
Figure 6:
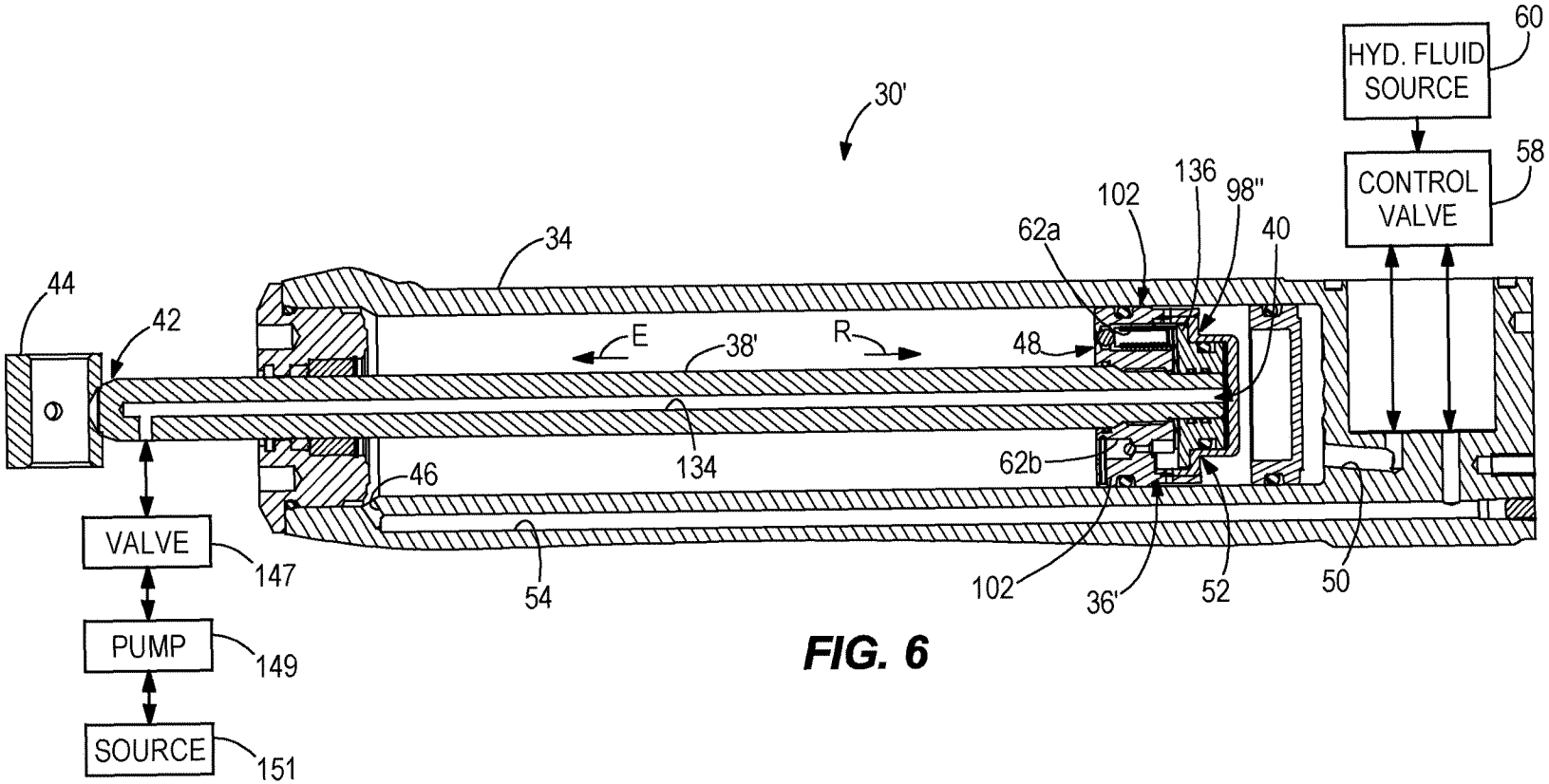
FIG. 6 illustrates a cross section of a trim actuator according to another example of the present disclosure.

The brake could take many forms, but in the example shown, referring to FIGS. 3-5, comprises the noted brake pads 120*a*, 120*b* situated within the brake housing 118. The brake housing 118 may be an integral part of the cylinder 34, or may be a separate part that has been welded or otherwise fastened to the exterior surface of the cylinder 34. The brake housing 118 includes a bore 122 extending perpendicular to the main axis of the cylinder 34. The bore 122 is connected to a source of hydraulic fluid, for example provided via tube 124 and fitting 126, which are held to the brake housing 118 by a connector 128. The hydraulic fluid could be sourced from the same hydraulic fluid source 60 described above, or could be provided from a separate source of hydraulic fluid shown at 151 (see FIG. 3). The controller 82 can be programmed to provide the hydraulic braking fluid to the brake housing 118 via the tube 124 when the controller 82 determines that the marine propulsion device 10 is being commanded in reverse, as described herein above, so that the pressure on the trim system created by high reverse thrust does not cause the trim actuator 16 to extend. For example, referring to FIG. 3, the controller 82 can send a signal to a bidirectional control valve 147 to provide hydraulic fluid from source 151, which fluid has been pressurized by pump 149. In one example, the braking fluid is sourced from the steering fluid supply.

Referring to FIG. 4, provision of hydraulic fluid into the bore 122 (as shown by the arrows) and between the inner wall of the brake housing 118 and a piston 130 provided within the bore 122 causes the piston 130 to move axially within the bore 122, and perpendicular to the main axis of the cylinder 34. Movement of the piston 130 due to application of pressurized hydraulic fluid causes the brake pad 120*a* to press against the brake rod 104, which in turn presses against the brake pad 120*b*, which in turn presses against an end wall 132 of the bore 122, for example located proximate an outer surface of the cylinder 34. Application of the brake pads 120*a*, 120*b* on either side of the brake rod 104 causes the brake rod 104 to be held in place and prevented from moving. Therefore, application of the brake pads 120*a*, 120*b* on the brake rod 104 also prevents movement of the piston 36 even upon the occurrence an overpressure event, which would otherwise extend the trim rod 38 from the cylinder 34 in the direction of arrow E by way of the shock relief mechanism 96 as described herein above.

FIG. 5 shows an instance in which the brake pads 120*a*, 120*b* are not engaged with the brake rod 104. In other words, the brake rod 104 is allowed to reciprocate back and forth through the brake housing 118 without being hindered by application of the brake pads 120*a*, 120*b*. FIG. 5 therefore shows a situation in which the controller 82 has not determined that the marine propulsion device 10 has been commanded in reverse, and therefore is not commanding hydraulic fluid to be provided to the bore 122 within the brake housing 118. FIG. 5 can also show situations in which, even though the controller 82 has determined that the marine propulsion device 10 is being commanded in reverse, the controller 82 has also sensed that a collision is about to occur, or that the reverse thrust produced by the marine propulsion device 10 is not greater than a certain threshold that would cause the shock relief mechanism 96 to activate, as described herein above.

Now turning to FIGS. 6-8, another example of an arresting mechanism 98" will be described with respect to piston-cylinder 30'. In this example, the arresting mechanism 98"

acts on the shock relief part 102 of the piston 36' inside of the cylinder 34. Many parts of the piston-cylinder 30' shown in FIGS. 6-8 remain the same as those shown in FIG. 3; however, there are a few notable differences. First, the brake rod 104, brake housing 118, and brake pads 120*a*, 120*b* have been removed. Additionally, a bore 134 is provided axially through the center of the trim rod 38', and the first end 40 of the trim rod 38' is provided with a somewhat different assembly than that shown in FIG. 3. More specifically, the first end 40 of the trim rod 38' holds the arresting mechanism 98", which in this example forms part of the piston 36', and comprises a braking part 136 coupled coaxially with the shock relief part 102 to the trim rod 38'. The braking part 136 can prevent movement of the piston 36' that would otherwise be caused by an overpressure event by selectively closing the relief passages 62*a*, 62*b* that were described herein above.

In the example shown, the braking part 136 is located on a non-rod side of the piston 36' (i.e., on the cylinder-side 52) and is located between the shock relief part 102 and a cap 138. The braking part 136 extends at least partially into the cap 138, and the outer circumference of the braking part 136 contacts the inner circumference of the cap 138. The braking part 136 is movable with respect to both the shock relief part 102 and the cap 138 so as to open and close the relief passages 62*a*, 62*b*. In other examples, the braking part 136 could be provided on the rod-side 48 of the piston 36'.

As described herein above, the shock relief part 102 comprises at least one valve such as shown at 64 or 74 that controls flow of hydraulic fluid through at least one relief passage, such as 62*a* or 62*b*. When the braking part 136 is moved toward the shock relief part 102 in response to an activation signal from the controller 82, the braking part 136 closes the at least one valve, such as shown at 64 or 74. The activation signal from the controller 82 may be in response to a determination by the controller 82 that the marine propulsion device 10 is being commanded in reverse as described herein above. In one example, the braking part 136 is hydraulically actuated. The bore 134 through the trim rod 38' acts as an axially-extending passageway that provides hydraulic braking fluid to a space between the cap 138 and the braking part 136 so as to move the braking part 136 toward the shock relief part 102 and close the valves 64, 74. Hydraulic fluid could be provided through the bore 134 in the trim rod 38' from the same hydraulic fluid source that causes extension and retraction of the trim rod 38' to and from the cylinder 34, as shown schematically at 60 in FIG. 6. Alternatively, the hydraulic braking fluid could be provided from a separate source 151.

The braking part 136 and the cap 138 both have a stepped cylindrical shape, with annular steps shown facing each other at 139, 141, although other shapes could be used. An O-ring 142 is provided in a recess around braking part 136, and contacts the inner circumference of the cap 138, so as to maintain the braking fluid in the space 140 between the cap 138 and the braking part 136. Further O-rings 144 are provided around the outside of the trim rod 38' and between the trim rod 38' and an inner circumference of the braking part 136 that axially surrounds the trim rod 38', in order to prevent hydraulic fluid from leaking between these two parts. The cap 138 is coupled to the shock relief part 102 in a fluid-tight manner, such as by way of a threaded connection at 143, and therefore does not move with respect to the shock relief part 102 despite the presence of pressurized hydraulic fluid between the cap 138 and the braking part 136. Instead, as pressure builds in the fluid-tight space 140, the braking part 136 is forced in the direction of arrow B (see FIG. 7) away from the cap 138 and towards the shock relief part 102.

Referring to FIG. 7, when the braking part 136 moves in the direction of arrow B, it pushes against the spring 70 and plunger 68, which in turn push the ball 66 onto its seat 72, thereby preventing flow of fluid through the relief passage 62*a*. Any pressure that builds up on the rod-side 48 of the piston 36' will not be enough to overcome the force of the braking part 136 holding the ball 66 on its seat 72, by virtue of the fact that the surface area on the end face 146 of the braking part 136 against which pressurized hydraulic fluid acts is much greater than the surface area of the ball 66 against which fluid that has been pressurized due to an overpressure event acts. It should be understood that while the shock relief part 102 may in fact be provided with many more relief passages than the two 62*a*, 62*b* that are shown, such as a number of passageways spaced circumferentially around the trim rod 38' as described above, the pressure of the fluid applied against the end face 146 of the braking part 136 will purposefully be increased to a value greater than that of the additive pressure acting on each of the ball valves arranged in the shock relief part 102.

FIG. 7 shows a situation in which the controller 82 has determined that the marine propulsion device 10 is being commanded in reverse, and therefore has sent a signal to a bidirectional control valve 147 to provide hydraulic fluid from source 151 through the bore 134 in the trim rod 38', which fluid has been pressurized by pump 149. This fluid flows in the direction of the arrows shown in FIG. 7, and fills the space 140, creating pressure against the end face 146 of the braking part 136, which closes the valve 64.

On the other hand, FIG. 8 shows a situation in which the controller 82 is not providing a command for hydraulic fluid to be supplied through the bore 134 to the space 140 between the cap 138 and the braking part 136. This may be when the controller 82 has not determined that the marine propulsion device 10 is being commanded in reverse, when the underwater impact sensor 90 senses an imminent impact, or when the reverse thrust of the marine propulsion device 10 has not exceeded the certain threshold. In any case, a biasing mechanism such as a Belleville washer 148 or other type of spring forces the braking part 136 away from the shock relief part 102. The annular step 139 on the braking part 136 contacts the annular step 141 in the cap 138, and prevents further movement of the braking part 136. The braking part 136 therefore no longer presses the spring 70 and plunger 68 against the ball 66 onto its seat 72. In other words, the ball 66 is free to push against the plunger 68 and overcome the force of the spring 70 due to an overpressure event on the rod-side 48 of the piston 36', to thereby allow fluid to flow as shown by the arrows through the relief passage 62*a* and out a side passage 150 to the cylinder-side 52 of the piston 36'. This allows the trim rod 38' to extend in the direction of arrow E, see FIG. 6, in order to trim the marine propulsion device 10 up and out of the way of whatever object caused the overpressure event. Once the overpressure event has discontinued, fluid may flow from the cylinder-side 52 of the piston 36' through side passage 152 and then through relief passage 62*b*, past valve 74 and into the rod-side 48 of the piston 36'. In other words, without the braking part 136 holding the valve 64 shut, the shock relief part 102 is able to function normally.

Referring to both FIGS. 7 and 8, one component that has not yet been described is the memory piston 154. The memory piston 154 moves as hydraulic fluid is provided to the rod-side 48 of the piston 36' or the cylinder-side 52 of the piston 36' via inlets 46 or 50 and control valve 58, as described herein above. However, the memory piston 154 does not move during the occurrence of an overpressure event. For instance, when an overpressure event occurs and forces the trim rod 38' in the direction of arrow E, the memory piston 154 remains in place, while the shock relief part 102 moves with the trim rod 38'. After the overpressure event is over, as fluid flows back from the space 156 between the memory piston 154 and the shock relief part 102, for example through passages 152 and 62*b*, the shock relief part 102 and trim rod 38' move in the direction of arrow R until they are stopped by the presence of the memory piston 154. This allows the marine propulsion device 10 to return to the trim position it had prior to occurrence of the overpressure event. Although the memory piston 154 is not described with respect to FIG. 3, it should be understood that a similar type of device exists in the first embodiment described herein above.

Figure 10:
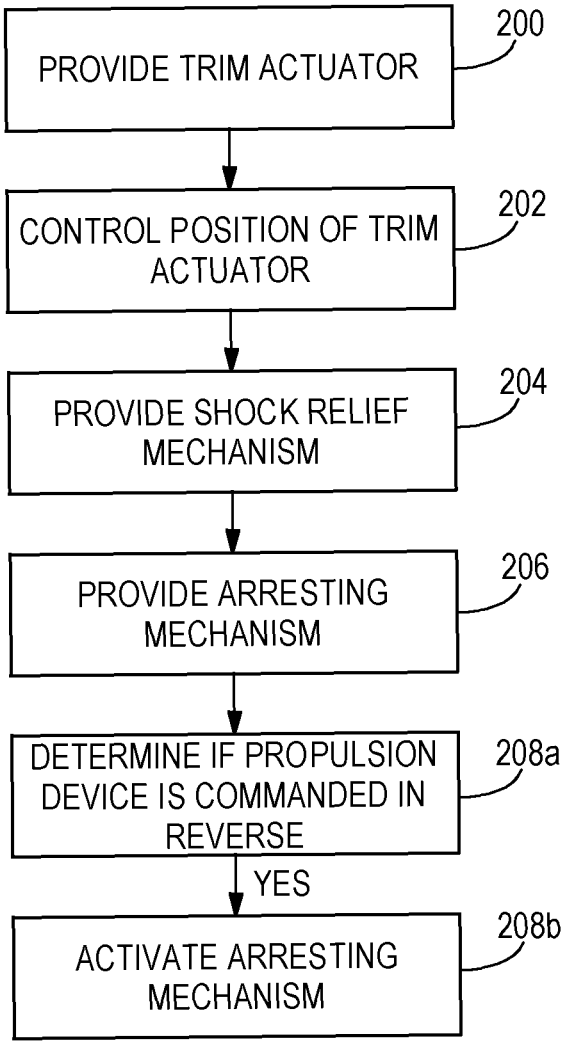
FIG. 10 illustrates one example of a method for controlling trim position of a marine propulsion device according to the present disclosure.

Now turning to FIG. 10, a method for controlling trim position of a marine propulsion device 10 on a marine vessel will be described. The method comprises, as shown at 200, providing a trim actuator 16 having a first end 18 that is configured to couple to the marine propulsion device 10 and a second end 20 that is configured to couple to the marine vessel, the trim actuator 16 being movable between an extended position wherein the marine propulsion device 10 is trimmed up with respect to the marine vessel and a retracted position wherein the marine propulsion device 10 is trimmed down with respect to the marine vessel. With reference to 202, the method further includes controlling, with a controller 82, position of the trim actuator 16 between the extended position and the retracted position. This can be done using the hydraulic fluid source 60 and control valve 58 described with respect to FIGS. 3 and 6, under control of the system 80 described with respect to FIG. 9. As shown at 204, the method may further include providing a shock relief mechanism 96 that overrides position control by the controller 82 and allows extension of the trim actuator 16 upon the occurrence of an overpressure event. This can be done according to the description of relief passages 62*a*, 62*b* provided herein above with respect to FIGS. 3, 7, and 8. As shown at 206, the method may further include providing an arresting mechanism ', 98', 98" that when activated prevents extension of the trim actuator 16 beyond a certain limit. The arresting mechanism may be the mechanism 98', including brake rod 104 and brake pads 120*a*, 120*b* situated within brake housing 118 described with respect to FIGS. 1-5. Alternatively, the arresting mechanism may be that shown at 98", comprising a braking part 136 of a piston 36' coupled to a shock relief part 102 of the piston 36' via a cap 138, as described with respect to FIGS. 6-8. Although the arresting mechanisms shown herein are actuated hydraulically, they could instead be mechanically, pneumatically, or electrically actuated. As shown at 208*a*, the method may further include determining with the controller 82 whether the marine propulsion device 10 is being commanded in reverse, and if so, as shown at 208*b*, activating the arresting mechanism 98, 98', 98" with the controller 82. These determinations can be made according to the description provided herein above with respect to FIG. 9.

Figure 11:
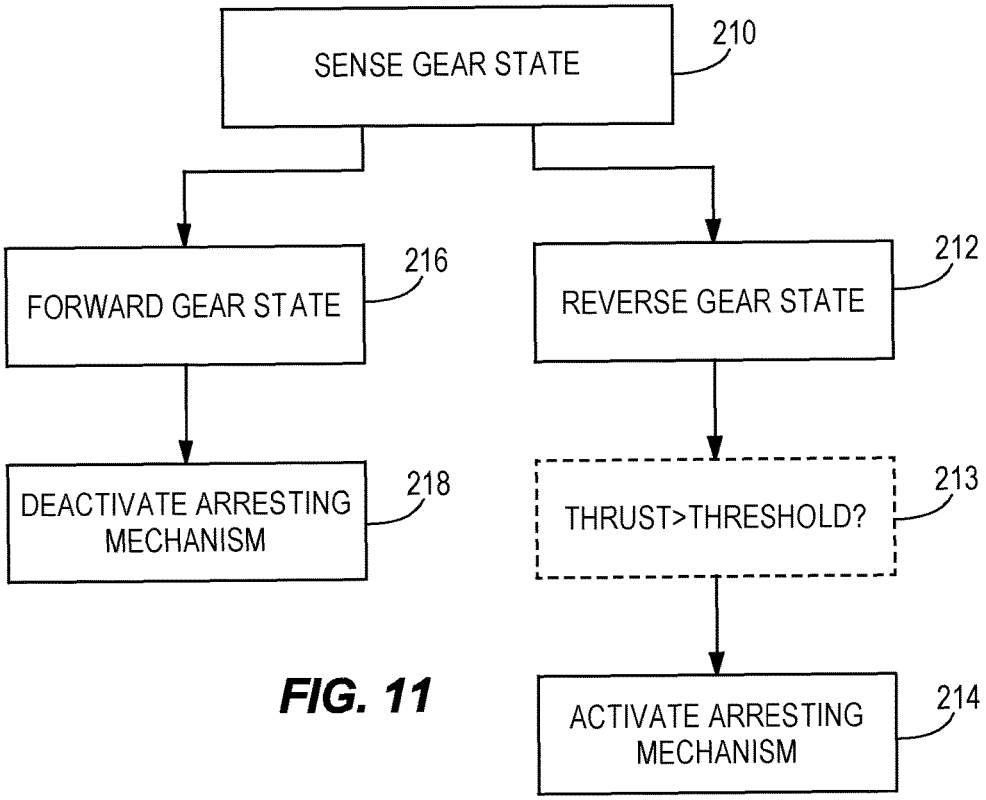
FIG. 11 illustrates a further example of a method for controlling trim position according to the present disclosure.

In one example, as shown in FIG. 11, the method includes determining with the controller 82 whether the marine propulsion device 10 has been placed in reverse gear, as shown at 210. If the reverse gear state is sensed as shown at 212, the controller 82 may activate the arresting mechanism 98, thereby preventing extension of the trim actuator 16 that might otherwise be caused by an overpressure event due to a high reverse thrust produced by the marine propulsion device 10. This is shown at 214. Otherwise, if the sensed gear state is a forward gear state, as shown at 216, the controller 82 may deactivate the arresting mechanism 98, as shown at 218. In other words, the shock relief mechanism 96 may function as normal and may allow the trim actuator 16 to extend in the event of an overpressure event. In one example, not only does the controller 82 determine whether the marine propulsion device 10 has been commanded to be placed in reverse gear, the controller 82 also determines whether the marine propulsion device 10 has been commanded to produce a reverse thrust that exceeds a certain threshold. This optional additional step is shown at 213. If the thrust does exceed the certain threshold, the controller 82 may activate the arresting mechanism 98. In one example, the reverse thrust threshold corresponds to a force on the marine propulsion device 10 that would otherwise cause an overpressure event and activate the shock relief mechanism 96.

Figure 12:
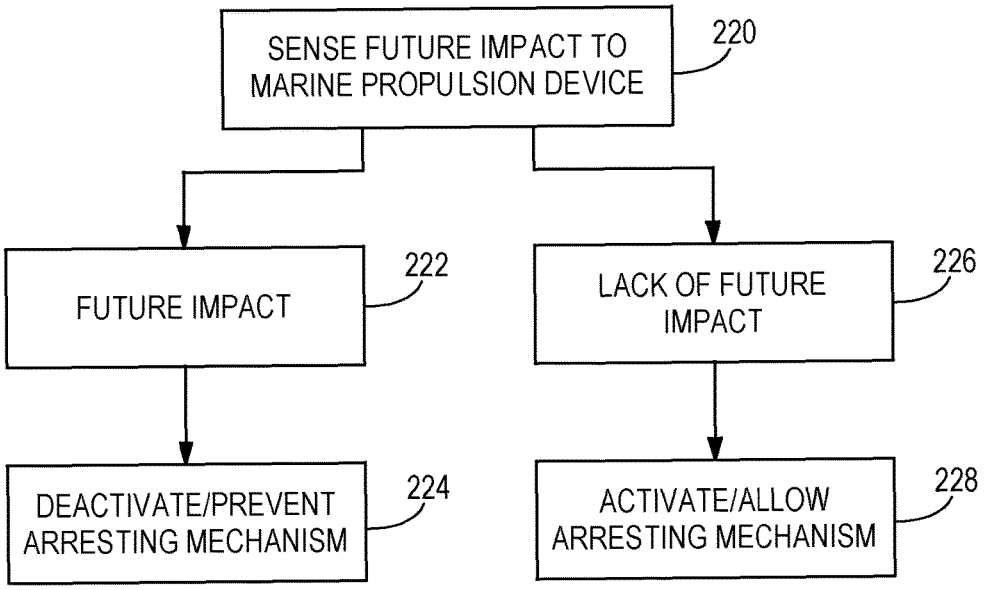
FIG. 12 illustrates yet a further example of a method for controlling trim position according to the present disclosure.

Turning to FIG. 12, fail safes can be provided that prevent damage to the marine propulsion device 10, even when the arresting mechanism 98 has been actuated due to a sensed reverse gear state and/or production of thrust greater than the certain threshold. For example, as shown at box 220, the method may include sensing a future impact to the marine propulsion device 10. If future impact is sensed, as shown at 222, the method may include deactivating the arresting mechanism 98 (if it has already been activated) as shown at 224, or preventing it from being activated if it has not yet been activated. On the other hand, if there is a lack of future impact, as shown at 226, the method may include activating the arresting mechanism 98 (or allowing it to be or remain activated), as shown at 228, so long as the other activation criteria described herein above are met.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A system for controlling trim position of a marine propulsion device on a marine vessel, the system comprising:

a trim actuator having a first end that is configured to couple to the marine propulsion device and a second end that is configured to couple to the marine vessel, the trim actuator being movable between an extended position wherein the marine propulsion device is trimmed up with respect to the marine vessel and a retracted position wherein the marine propulsion device is trimmed down with respect to the marine vessel;

a controller that controls position of the trim actuator between the extended position and the retracted position;

a shock relief mechanism that overrides position control by the controller and allows extension of the trim actuator upon an occurrence of an overpressure event; and an arresting mechanism that when activated acts on a component of the trim actuator to prevent extension of the trim actuator beyond a certain limit;

wherein the controller selectively activates the arresting mechanism in response to a determination that the marine propulsion device is being commanded in reverse.

2. The system of claim 1, wherein the controller activates the arresting mechanism in response to the marine propulsion device being placed in reverse gear.

3. The system of claim 2, wherein the controller activates the arresting mechanism in response to the marine propulsion device being commanded to produce a reverse thrust that exceeds a certain threshold.

4. The system of claim 3, wherein the reverse thrust threshold corresponds to a force on the marine propulsion device that would otherwise cause the overpressure event and activate the shock relief mechanism.

5. The system of claim 1, wherein the trim actuator is a hydraulic actuator and further comprises a cylinder, a piston that reciprocates back and forth in the cylinder, and a trim rod that is coupled to the piston and extends from the cylinder, and wherein the arresting mechanism prevents the piston and trim rod from moving more than a certain extent with respect to the cylinder.

6. The system of claim 5, wherein the piston comprises a shock relief part having a relief passage that conveys hydraulic fluid past the piston as the trim actuator is forced by the overpressure event into or out of the extended and retracted positions.

7. The system of claim 6, wherein the arresting mechanism acts on the trim rod outside of the cylinder.

8. The system of claim 7, wherein the arresting mechanism comprises a brake rod coupled to the trim rod, and brake pads that selectively prevent movement of the brake rod in response to an activation signal from the controller, thereby also preventing movement of the trim rod.

9. The system of claim 8, wherein the brake pads are hydraulically actuated.

10. The system of claim 6, wherein the arresting mechanism acts on the shock relief part of the piston inside of the cylinder.

11. The system of claim 10, wherein the arresting mechanism forms part of the piston, and comprises a braking part coupled coaxially with the shock relief part to the trim rod, wherein the braking part selectively opens and closes the relief passage.

12. The system of claim 11, wherein the braking part is located on a non-rod side of the piston between the shock relief part and a cap, and wherein the braking part is movable with respect to the shock relief part and the cap so as to open and close the relief passage.

13. The system of claim 12, wherein the shock relief part further comprises a valve that controls flow of the hydraulic fluid through the relief passage, and wherein when the braking part is moved toward the shock relief part in response to an activation signal from the controller, the braking part closes the valve.

14. The system of claim 13, wherein the braking part is hydraulically actuated.

15. The system of claim 14, wherein the trim rod has an axially-extending passageway that provides hydraulic braking fluid to a space between the cap and the braking part so as to move the braking part toward the shock relief part.

16. The system of claim 13, wherein the valve is a check valve.

17. The system of claim 5, further comprising a source of hydraulic fluid that supplies hydraulic fluid to the hydraulic actuator, a first inlet to the cylinder on a rod-side of the piston, a second inlet to the cylinder on a cylinder-side of the piston, and a control valve that controls flow of the hydraulic fluid to the rod-side of the piston and the cylinder-side of the piston, wherein flow of the hydraulic fluid to the rod-side of the piston causes the piston to move such that the trim rod further retracts into the cylinder and wherein flow of the hydraulic fluid to the cylinder-side of the piston causes the piston to move such that the trim rod further extends from the cylinder.

18. The system of claim 1, further comprising a trim limit input device, which allows an operator to select the certain limit beyond which the trim actuator cannot extend.

19. A method for controlling trim position of a marine propulsion device on a marine vessel, the method comprising:

providing a trim actuator having a first end that is configured to couple to the marine propulsion device and a second end that is configured to couple to the marine vessel, the trim actuator being movable between an extended position wherein the marine propulsion device is trimmed up with respect to the marine vessel and a retracted position wherein the marine propulsion device is trimmed down with respect to the marine vessel;

controlling, with a controller, position of the trim actuator between the extended position and the retracted position;

providing a shock relief mechanism that overrides position control by the controller and allows extension of the trim actuator upon an occurrence of an overpressure event;

providing an arresting mechanism that when activated prevents extension of the trim actuator beyond a certain limit;

determining with the controller whether the marine propulsion device (a) is being commanded in reverse, (b) has been placed in reverse gear, and (c) has been commanded to produce a reverse thrust that exceeds a certain threshold; and in response to (a), (b), and (c) being true, activating the arresting mechanism with the controller.

20. The method of claim 19, wherein the reverse thrust threshold corresponds to a force on the marine propulsion device that would otherwise cause the overpressure event and activate the shock relief mechanism.

21. A system for controlling trim position of a marine propulsion device on a marine vessel, the system comprising:

a trim actuator having a first end that is configured to couple to the marine propulsion device and a second end that is configured to couple to the marine vessel, the trim actuator being movable between an extended position wherein the marine propulsion device is trimmed up with respect to the marine vessel and a retracted position wherein the marine propulsion device is trimmed down with respect to the marine vessel;

a controller that controls position of the trim actuator between the extended position and the retracted position;

a shock relief mechanism that overrides position control by the controller and allows extension of the trim actuator upon an occurrence of an overpressure event;

an arresting mechanism that when activated prevents extension of the trim actuator beyond a certain limit; and a trim limit input device, which allows an operator to select the certain limit beyond which the trim actuator cannot extend;

wherein the controller selectively activates the arresting mechanism in response to a determination that the marine propulsion device is being commanded in reverse.

* * * * *